United States Patent [19]

Pelsue et al.

[11] Patent Number: 4,941,499

[45] Date of Patent: Jul. 17, 1990

[54] GROUND TENT WITH EXTERNAL FRAME AND IMPROVED SUBFRAME THEREFOR

[75] Inventors: Bradley A. Pelsue, Englewood; Mark R. Niksic, Lakewood, both of Colo.

[73] Assignee: T. A. Pelsue Company, Englewood, Colo.

[21] Appl. No.: 332,791

[22] Filed: Apr. 3, 1989

[51] Int. Cl.[5] ..... E04H 15/40

[52] U.S. Cl. ..... 135/104; 135/105; 135/106; 403/93; 403/172

[58] Field of Search ..... 135/105, 87, 104, 119, 135/106, 109, 118, 101, 98; 285/118, 261, 274, 275; 403/172, 93, 176

[56] References Cited

U.S. PATENT DOCUMENTS

| | | | |
|---|---|---|---|
| 2,568,060 | 9/1951 | Dumble | 285/118 |
| 2,643,900 | 6/1953 | McBride | 285/118 |
| 2,948,287 | 8/1960 | Rupert | 135/104 |
| 3,224,793 | 12/1965 | Benjamin | 285/261 X |
| 3,810,482 | 5/1974 | Beavers | 135/109 |
| 3,941,140 | 3/1976 | Beavers | 135/109 |
| 3,968,809 | 7/1976 | Beavers | 135/112 X |
| 4,026,312 | 5/1977 | Beavers | 135/109 |
| 4,077,417 | 3/1978 | Beavers | 135/106 |
| 4,285,354 | 8/1981 | Beavers | 135/102 |
| 4,414,993 | 11/1983 | Gillis | 135/104 |
| 4,637,748 | 1/1987 | Beavers | 135/109 X |
| 4,750,509 | 6/1988 | Kim | 135/105 X |

FOREIGN PATENT DOCUMENTS

| | | | |
|---|---|---|---|
| 2914760 | 10/1979 | Fed. Rep. of Germany | 135/104 |

*Primary Examiner*—David A. Scherbel
*Assistant Examiner*—Lan Mai
*Attorney, Agent, or Firm*—Richard W. Hanes

[57] ABSTRACT

A tenting structure with two angularly related sidewalls forming a roof and having at least one collapsible frame for externally supporting each of the sidewalls and where the frame includes a hub radially carrying a plurality of flexible struts whose distal ends are secured in external pockets positioned around the edges of each of the sidewalls and where the frame is sized and dimensioned in respect to the sidewalls that the frame members take on a compression induced dish shaped outward bow. The hub includes a plurality of pivotal strut mounting sockets which rotate about their pivotal axis to a discrete splayed position and to a definitive stowed position.

8 Claims, 4 Drawing Sheets

GROUND TENT WITH EXTERNAL FRAME AND IMPROVED SUBFRAME THEREFOR

BACKGROUND OF THE INVENTION

The assignee hereof is the owner of several U.S. patents relating to tents of one type or another. Some are for highly specialized applications like, for example, its van tent forming the subject matter of U.S. Pat. No. 3,968,809 and what is primarily an aerial tent shown in U.S. Pat. No. 4,285,354. Four other U.S. patents, specifically U.S. Pat. Nos. 3,810,482, 3,941,140, 4,026,312, and 4,077,417 are all directed to ground tents of more or less general application. In addition, assignee owns U.S. Pat. No. 4,637,748, the subject matter of which is confined to the hub assembly at the center of the subframes used in tents of this general type.

All of these patents have in common a centrally-located hub from which radiate three or more struts which combine to form a foldable subframe. Two or more of these subframes are connected to one another and to the skin covering same to produce a unitary foldable tent structure. They also have in common the fact that the frame is always inside the skin and when folded the hubs come together with the portion of the skin covered thereby folding inside the resulting strut package. While the hubs function very well, are lightweight and very sturdy, they are expensive and labor intensive to manufacture, which fact prices the tent above the recreation tent market where, foreign competition sets the tone of the industry because of cheap labor.

Completely apart from the cost problem is the fact that constructing a serviceable recreation tent with an inside frame has presented a number of problems, especially where there is a need for a so-called "fly", that are not easily solved, at least not economically.

1. Field of the Invention

The present invention has to do with an improved ground tent having an external foldable frame incorporating a novel and much simpler hub and strut subassembly in the subframes. The resulting tent is ideally suited for recreational use and the addition of external fly sections covering both sidewalls and the subframes supporting the latter presents no problem whatsoever.

2. Description of the Related Art

No more pertinent prior art is known to applicant than those U.S. patents listed above, particularly U.S. Pat. Nos. 3,810,482, 3,941,140, 4,026,312, and 4,077,417, all of which relate to ground tents that are well-suited for recreational use. As previously noted in each prior art instance the frame is inside the weatherproof skin, the hub construction is entirely different and, for all practical purposes, no wall-covering fly is used although the '417 patent has a small fly used primarily for ventilation. It is in this latter patent that the closest prior art is found.

SUMMARY OF THE INVENTION

In accordance with the teaching of the present invention a greatly simplified and significantly improved ground tent can be constructed using the foldable subframe approach but disposing the subframe externally as opposed to internally of the tent body. With the skin of the tent on the inside of the frame structure, the frame members also function to hold the fly sections in spaced relation to the skin thus preventing moisture from getting through to the interior, while at the same time providing a dead airspace therebetween that functions as insulation and aids in holding the heat in. Portions of the skin can take the form of netting for ventilation purposes and the fly sections which are and remain attached to the skin can be rolled up and stowed at the ridge of the tent during good weather.

The distal strut ends are easily attached and detached from the skin through the use of strut-end-receiving pockets sewn to the latter. The need for stringing ropes or cables through hems in the skin in order to interconnect adjacent distal strut ends is eliminated along with the high cost of doing so.

The overall practicality of the tent is due first to the manufacturing simplicity of the improved snap-together design of the subframe hub and the novel strut end connectors and secondly to the advantages inherent in the erected tent because of the external frame construction.

It is, therefore, the principal object of the present invention to provide a novel and improved ground tent of the type ideally suited for recreational use.

A second objective is that of providing a ground tent having an externally disposed foldable frame made up of two or more foldable subframes which are and remain attached to the skin but fold up inside the latter in stowed condition.

An additional object is to provide a unique and greatly simplified snap-together hub and much improved strut end connector for use therewith, both of which substantially reduce the cost of the parts as well as the amount of labor involved in manufacturing same.

A specific objective of the hub design, in addition to its ease of assembly during manufacture, is the provision of a body for the hub which absorbs all stresses created by the flexible struts and isolates those stress away from the enclosing cap of the hub which in this inventive construction, acts merely to passively contain the working parts inside the hub body.

Another specific objective of the hub construction is to prevent rotation of the bracing struts carried by the hub and provide discrete positions for the struts in extended and folded positions.

Another overall objective is providing a ground tent of the type described which incorporates foldable wall-covering fly sections that are attached to the skin along the ridge between the sidewalls where they can be rolled up and stowed when not in use.

Still another object of the invention is to provide a skin and frame subassembly in a ground tent which cooperate with one another to maintain a weather fly in spaced relation to the skin therebeneath.

Other objects are to provide a foldable ground tent which is lightweight yet rugged, compact, versatile, easy to erect and take down, relatively inexpensive, simple to assemble and one that is even quite decorative.

Other objects will be in part apparent and in part pointed out in the description that follows taken in conjunction with the accompanying drawings.

DESCRIPTION OF THE PREFERRED EMBODIMENTS

Figure 1:
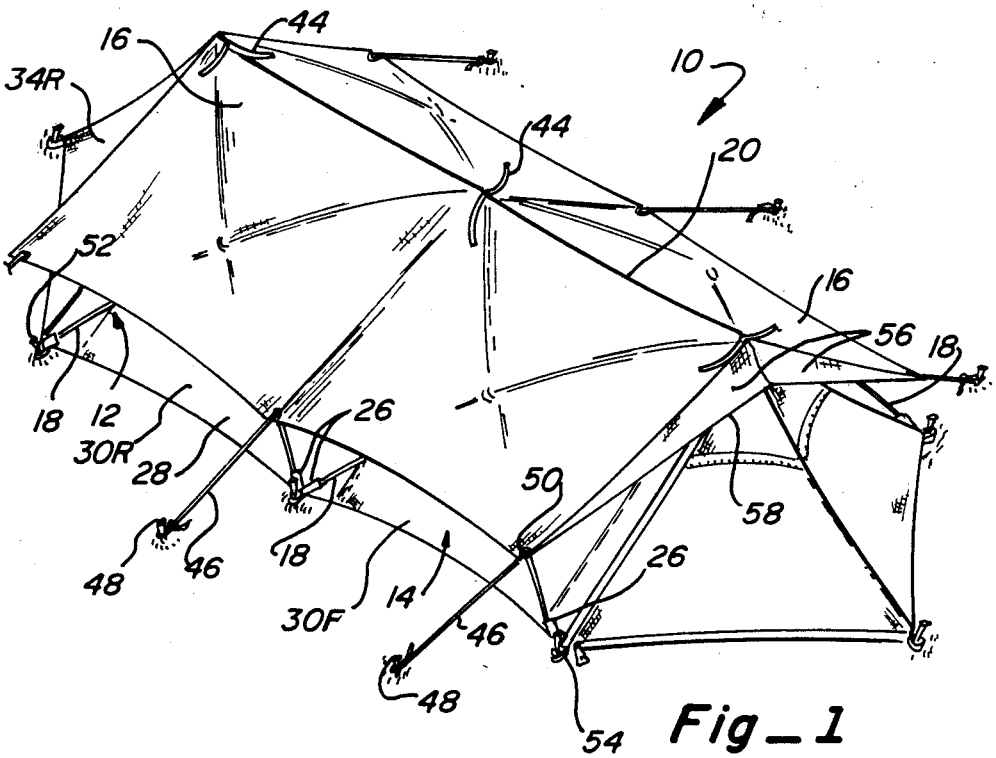
FIG. 1 is a perspective view showing the ground tent erected and with its fly sections deployed.

Referring next to the drawings for a detailed description of the present invention and, initially, to FIGS. 1–5 for this purpose reference numeral 10 has been chosen to designate the tent in its entirety. The tent consists of a frame 12, a skin 14 forming a sidewall or roof 28, and a pair of stowable fly sections 16 sewn to the top edges of the sidewalls along the ridge lines 20. In the particular embodiment shown, the frame 12 comprises four subframes 18 arranged continguously in the four quarters of a rectangle divided along its longitudinal axis 20 to form an inverted "V" shaped structure. The sidewalls 28 are sewn together along the line forming the tent hip or ridge 20. Each subframe 18 is shown to include four rod-like struts 22, the inner or proximal ends of which are connected to a hub 24 which will be described in detail in connection with FIGS. 8–13, inclusive.

Figure 2:
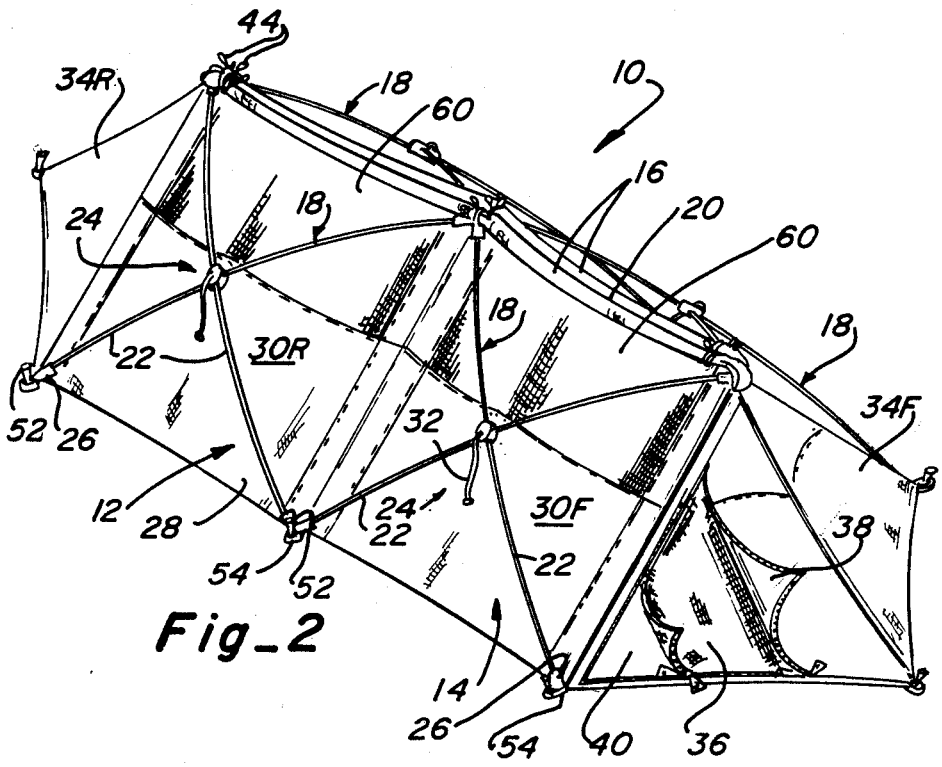
FIG. 2 is a perspective view like FIG. 1 and to the same scale but differing therefrom in that the fly sections are shown rolled up and stowed.
Figure 4:
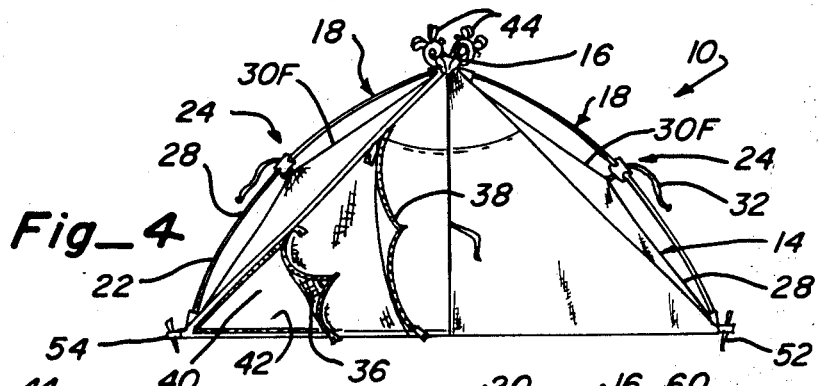
FIG. 4 is a front elevation of the tent, again to the same scale.
Figure 5:
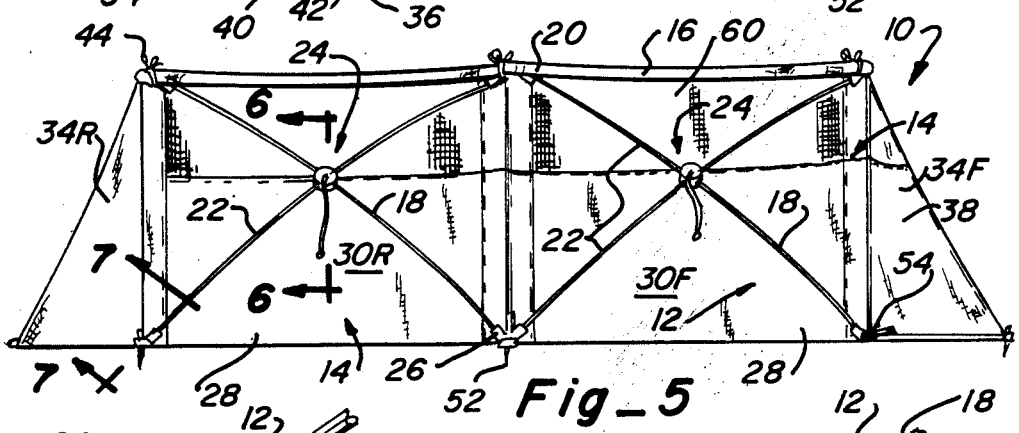
FIG. 5 is a side elevation thereof, also to the same scale.
Figure 6:
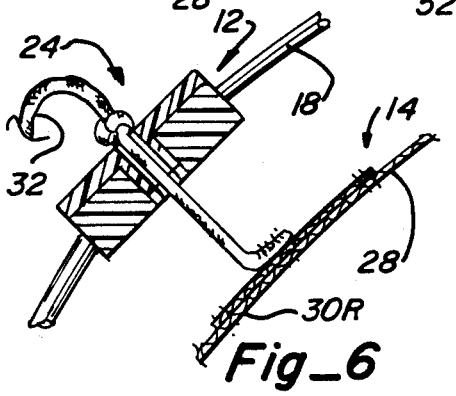
FIG. 6 is an enlarged fragmentary sectional detail taken along line 6—6 of FIG. 5.
Figure 7:
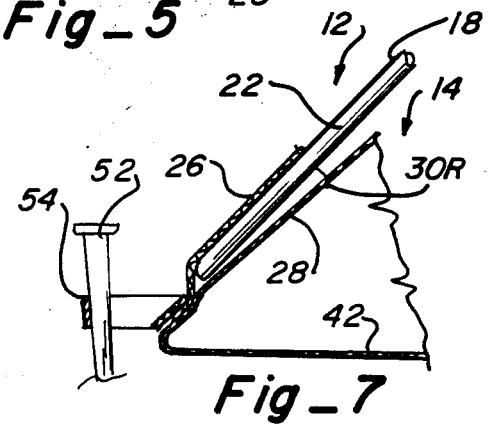
FIG. 7 is a fragmentary sectional detail to approximately the same scale as FIG. 6 taken along line 7—7 of FIG. 5.
Figure 8:
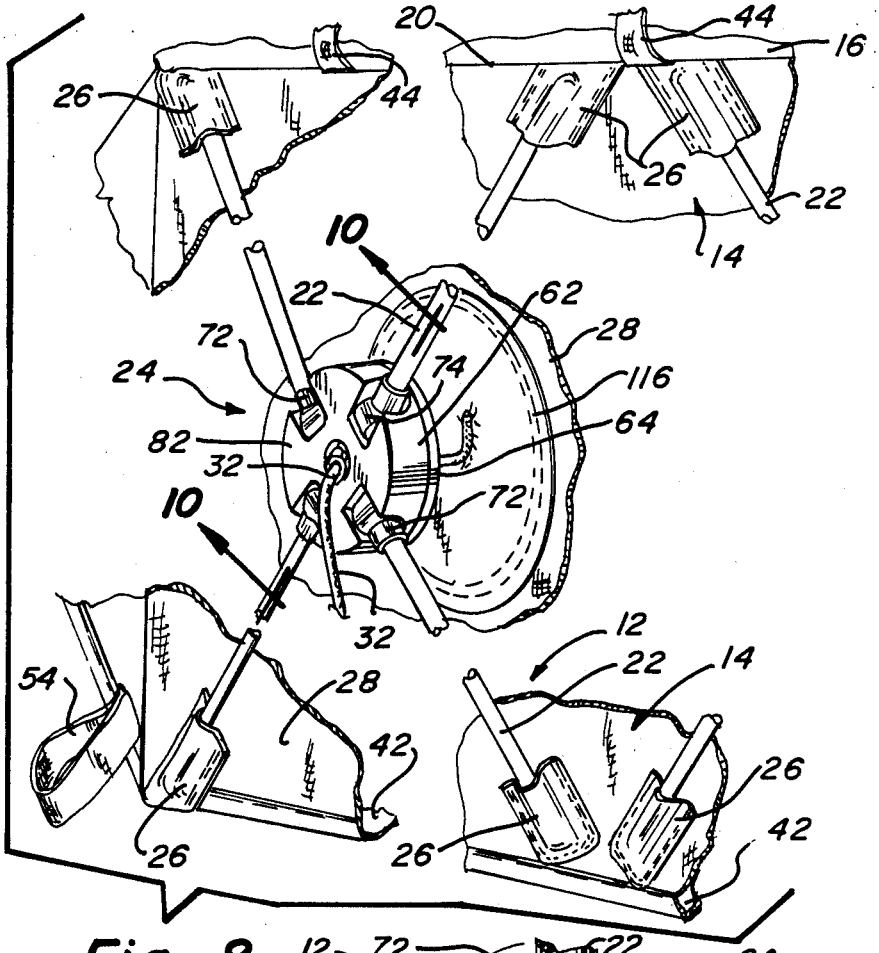
FIG. 8 is a fragmentary perspective view of the subframe assembly in which major have been broken away to conserve space.
Figure 9:
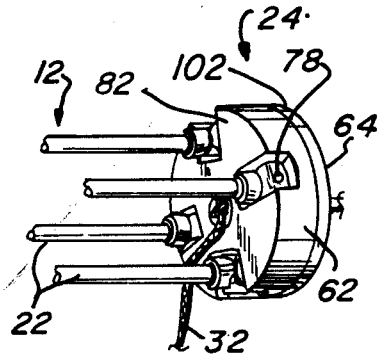
FIG. 9 is a fragmentary perspective view of the hub and strut subassembly showing the latter in folded position.

The skin 14 is detachably connected to the distal or outer ends of the struts 22 to form a unitary assembly by means of strut-end-receiving pockets 26 sewn onto the outer surface of the skin in a manner revealed most clearly in FIGS. 7 and 8. Four of these pockets are located at the corners of each of the two sidewalls 28 while two other pairs are positioned in side-by-side relation halfway between the ends of each sidewall at the top and bottom edges thereof to receive the adjacent strut ends of the side-by-side subframes as seen in FIGS. 2 and 5. The resulting construction divides each sidewall 28 into two half panels 30F and 30R supported by its own subframe. At the center of each of the half panels 30F and 30R, a short lanyard 32 connects the latter to the hub 24 of its subframe as seen in FIGS. 6 and 8. Sewn to the sidewalls and forming integral parts of the frame are front and rear endwalls, 34F and 34R, respectively, of more or less conventional design, the front one having a double flap consisting of an inner mesh flap 36 and an outer solid one 38 as seen in FIGS. 2, 4 and 5. These flaps are detachably connected to one of the sidewalls to form an entryway 40 much like those shown in assignee's earlier ground tent patents referred to previously. A floor 42 is sewn or otherwise fastened to the side and endwalls of the tent and it functions to define and limit the lower separation of the sidewalls 28 to form an inverted V-shaped structure of the same general shape as that of U.S. Pat. No. 4,077,417 except that the front and rear endwalls of the present design are extended as seen in FIGS. 2 and 5.

Figure 3:
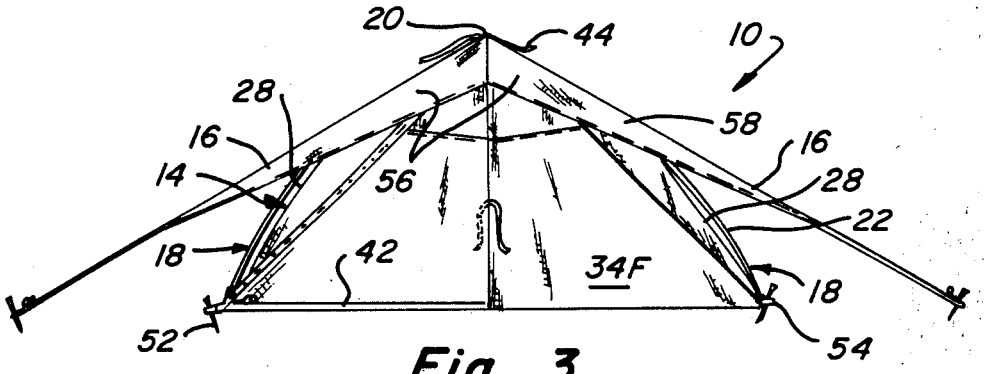
FIG. 3 is a rear elevation of the tent to the same scale as FIGS. 1 and 2 thereof broken away and shown in section.

The fly sections 16 comprise large flaps roughly the size of the sidewalls joined to the skin along the ridge 20. In stowed condition, they roll up as shown in FIGS. 2, 4 and 5 where they are tied by ties 44. In the taut extended position in which these fly sections cover the tent roof, as shown in FIGS. 1 and 3, short lanyards 46 attached to anchoring stakes 48 are trained through grommets 50 in the edges of the fly sections and then secured to tent anchoring stakes 52 to pull tension on the fly sections. Other stakes 52 located inboard of the stakes 48 pass through eyelets 54 sewn onto the lower margins of the sidewalls and function to anchor the structure to the ground in the manner commonly used with ground tents. In these same two figures of the drawing it can be seen that short extensions 56 of both fly sections cooperate to define a protective structure 58 overhanging the entryway 40. No such overhang is provided at the rear end nor is one required.

In FIGS. 2 and 5 it can be seen that the sidewalls are provided with windows 60 covered with mesh which are like the ones shown in assignee's earlier patents as well as many others. Likewise, as was the case with assignee's '417 patent, all of the subframes include the bendable struts 22 and a hub structure 24 wherein the struts move from a nested and stowed condition seen in FIGS. 9, 12 and 13 out into the extended outwardly-bowed position shown most clearly in FIGS. 2, 4, 5 and 8 where they cooperate with one another to define a free-standing frame 12. Thus, when the distal strut ends are seated in their respective pockets 26, as seen in FIG. 7, bending stresses are produced in the diametrically-opposed pairs of struts in each of the subframes which distend them into a bow where the struts and hub form the outline of an inverted dish whose concave side faces the tent sidewall. Preferably, but not absolutely necessary, the combined lengths of diametric strut pairs and the hub therebetween is substantially greater than the straightline distance between the bottom of the opposed pockets in which these strut ends are received. In connection with FIG. 6, it is noted that the hub 24 is connected to the skin panel underneath it by lanyard 32 thereby causing the sidewalls to bellow out in conformance with the distension of the subframes, thus increasing the inside volume of the tent. The overall action of each subframe, as the struts unfold from their nested position past a planar relation and on into a bowed position, was taught in assignee's earlier patents, however, the difference is that it was done before from inside the skin. In the present invention, the frames 18 are on the outside and function not only as supports but also as separators that keep the fly sections 16 from contacting the sidewalls 28 in inclement weather. Isolating the fly sections from the surface of the tent sidewalls 28 has proven to be very difficult to accomplish using those constructions in which both the skin and the fly sections are on the same side of the frame.

Figure 13:
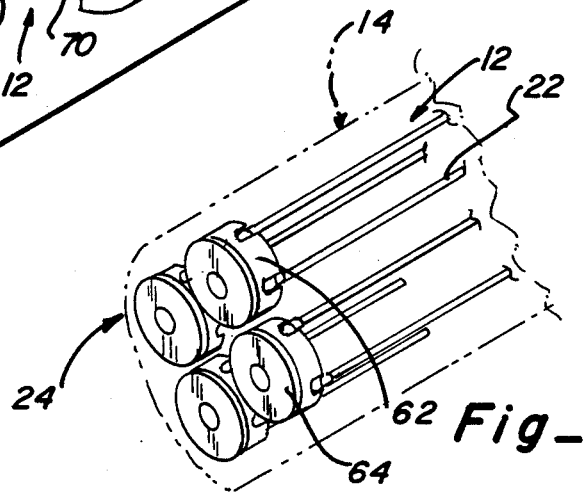

Dismantling of the tent is a simple matter and all that is required is to push inwardly on each of the subframe hubs, whereupon, the corresponding wall panels will collapse and fold around them "umbrella-fashion" to produce a compact and easily carried package like that shown in FIG. 13. To set up the tent, the reverse procedure is followed and the hubs are conveniently pulled into their extended positions by taking ahold of the lanyards 32 which attach them to the skin of the tent. Because of the strain put upon the fabric at these points of lanyard attachment, it is desirable to reinforce the fabric with suitable patches 116 as seen in FIG. 8. Should one of the distal strut ends come out of its pocket, it is a simple matter of bending the strut to the degree required to reinsert same or alternatively, do so with the tent collapsed when the fabric is not stretched taut.

Figure 10:
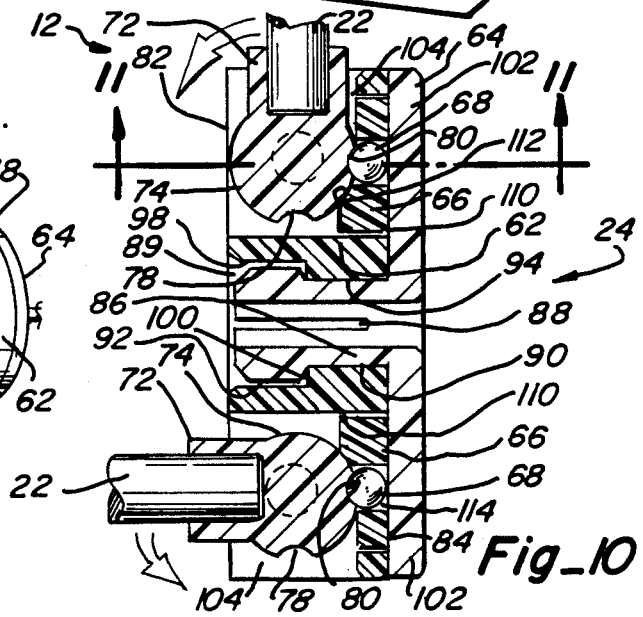
FIG. 10 is a still further enlarged fragmentary section taken along line 10—10 of FIG. 8.
Figure 11:
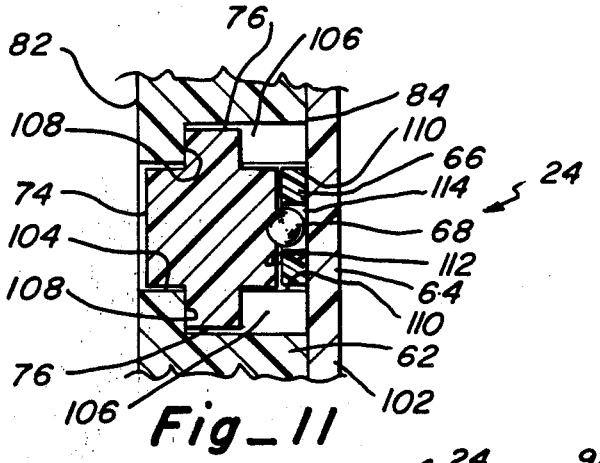
FIG. 11 is a fragmentary section taken along line 11—11 of FIG. 10 and to the same scale as the latter.

Turning now to that portion of the invention having to do specifically with the hub construction as it effects its manufacturing simplicity and operation in tent erection detailed reference will be made to FIGS. 10–12, inclusive.

The hub 24 consists of a base member 62, a detachable cap 64, four seats 66 and a corresponding number of ball detents 68 for use in each of the seats. The strut proximal endpieces each comprises a socket 72 for receiving the end of the strut to which it is glued or otherwise attached, a cylindrical journal 74 formed integrally with the socket and with its axis of rotation at right angles to the latter and a pair of integrally-formed pivot pins 76 projecting from opposite ends of the journal 74 in axial alignment with one another as well as with the axis of the journal 74. The surface of the journal also includes a pair of detent pits 78 and 80 (FIG. 10) which are preferably spaced apart circumferentially a little over 90°, the one 78 being on the side of the journal while the other 80 is on the bottom thereof opposite the socket 72.

For purposes of the present description, the cylindrically shaped base member 62 of the hub will be considered as having a front or forward face 82 and a rear face 84. The cap 64 covers the rear face 84 and is connected to the base by means of an integrally-formed slotted hollow pin 86, the slots 88 of which extend axially thereof dividing same into springable segments 90. The remote end of this pin is enlarged to define a tapered head 92 which is sized and shaped to enter the relatively smaller entryway 94 leading into the central opening 96 passing through the base member 62 thereby squeezing the segments together. Central opening 96 in the base member has an enlarged portion 98 opening onto the front face thereof which is separated from its entryway by an annular shoulder 100 which abuts the mating annular under surface of the head 88 of the pin 86 as the segments 92 thereof are permitted to spring back out from their compressed position as they are pushed through the tunnel or entryway 94 of the base 62, all of the latter being seen in FIGS. 9 and 12.

Figure 12:
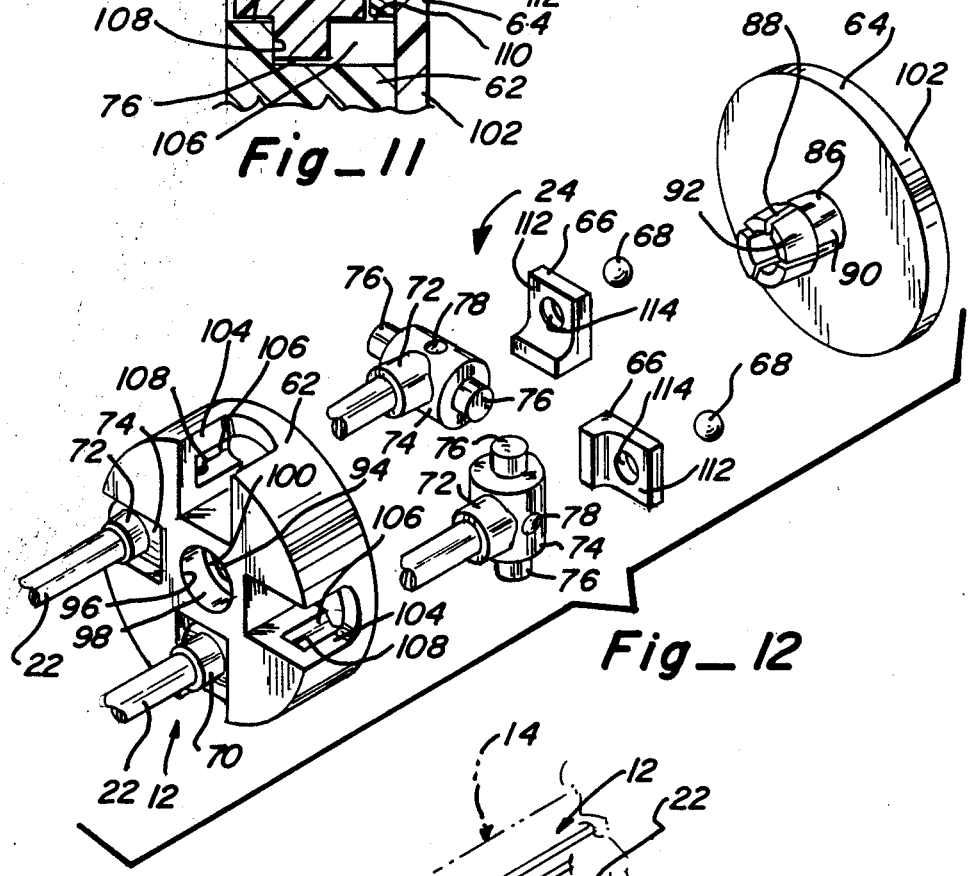
FIG. 12 is a perspective view of the hub and strut subassembly of FIG. 9 to a somewhat larger scale; and, FIG. 13 is a fragmentary perspective view to a greatly reduced scale showing how the four subframes fold up inside the skin of the tent.

The large circular flange 102 of the cap 64 covers the connector-receiving cavities 104 of the base member 62, the shape of the cavities being most clearly revealed in the exploded view of FIG. 12. Each cavity opens both forwardly onto the front face of the base member and radially onto its side surfaces permitting a strut 22 with its attached journal 74 to be seated in the cavity to rotate from a first stowed position into a second, radially extended position, both of which are shown in FIG. 10. A pair of diametrically-opposed semicylindrical grooves 106 are provided in each of the cavities 104 opening onto the rear face of the base member while terminating short of its front face to define ledges 108 against which the pivot pins 76 of the journal 74 bear and turn as the struts pivot from stowed to extended position. Cavities 104, in addition to opening onto the front face of the base member and out through the sides thereof, also open onto its rear face through a generally rectangular opening 110 that includes longitudinal grooves 106 in opposite sides thereof. The overall shape of the openings in the rear face which combine rectangular opening 110 and the pair of grooves 106 is such as to pass the cylindrical journal 74 along with its pivot pin-forming projections 76. Thus, each strut end connector subassembly is passed into and through one of the openings 110 in the rear face of the base in the manner shown in the exploded view FIG. 12 until the pivot pins 76 seat against the ledges 108 in the forward end of the grooves 106.

The strut end connector subassembly can, in a second or modified embodiment, be simplified by eliminating the pivot pins 76 and formulating the sides of each of the cavities 104 with internal shoulders to serve as bearings for the respective ends of the journals 74. The latter type of construction would require the thickener of the body 62 to be greater than for the pivot pin option. In either embodiment the journal 74 or the pins 76 prevents the attached strut from rotating about its longitudinal axis. With the strut thus stabilized, a hinge or articulating joint could be placed intermediate the strut ends to shorten the strut length during stowage.

Seats 66 are rectangular and sized to fit into the rectangular openings 110 leading into the cavities 104 found in the rear face of the base member. Each of these seats has its forwardly-facing surface 112 curved to provide a concave shape to mate with the cylindrical surface of the journal 74 which turns in the latter as the struts move between their stowed and extended positions in the manner best seen in FIG. 10. A spherical pocket 114 in the rear face of each of the seats and opening onto the front face thereof receives a ball detent 68 and exposes a portion of the latter to the cylindrical surface of the journal 74. The pits 78 and 80 are circumferentially aligned with one another and with the ball detent 68 which drops into one or the other of the pits and releasably stops the pivotal movement of the strut associated therewith and latches it in either its stowed or extended position as shown in FIG. 10. Flange 102 of the cap 64 holds the balls in place and it is sufficiently yieldable to permit them to back out of their openings in the seats 66 far enough so as to not block the rotation of the connectors as the balls ride between recesses.

The seats 66 could be replaced by equivalently functioning parts integrally molded into the cap flange 102. In such a construction, the ball detent 68 would preferably be replaced with a knob molded into the journal receiving bearing face of the integral seat. Alternatively, the knob or protrusion could be formed on the surface of the journal 74 with a notch or pit molded into the face of the seat.

Having seen the construction of the hub body and the method of mounting the pivotal strut end connector, it is apparent that all of the forces created by the moment arms of the extended struts 22 are resisted by the various elements of the hub body 62, including the sides and shoulders of the cavities 104. Since the bending forces in the struts are not directly felt by the cap 64 or its flange 102, it is not necessary to secure the cap to the body with multiple bolt or screw type of fasteners, as in the prior hub art of the earlier mentioned U.S. patents. The snap-together fastener formed by the cap pin 86 and its springable collapsible head 92, cooperating with the bore 94 and shoulder 100 of the hub body 62 makes assembly of the unit during manufacture substantially easier and cheaper than the use of bolts and is more than adequate from a strength perspective.

What is claimed is:

1. In a tenting structure:

a sidewall and roof assembly comprising a pair of inclined pliant erectile skin members each having external and internal surfaces and at least one common straight edge;

means interconnecting the skin members along their common straight edges wherein the erected skin members are adapted to be positioned so that the line defining their interconnection describes the vertex of the angle formed by the planes of the inclined skin members;

at least one frame means for supporting the skin members, each of which frame means includes;

a plurality of flexible struts; and hub means carrying the proximal ends of the struts, including a plurality of pivotal sockets carried by the hub to receive the proximal ends of the struts;

releasable stop means engaging the said sockets to arrest the movement thereof at the extremes of approximately 100° of rotation about the pivotal axis of the sockets;

a base member having a plurality of cavities, each having opposing side chambers defining bearing means at the forward end thereof;

journal means integral with the pivotal sockets and disposed for rotation in the bearing means; and curvilinearly faced seats, one each disposed in the bottom of each cavity and engaging the pivotal sockets on the side thereof opposite the surface thereof engaging the bearing means;

a plurality of pocket means integral with the skin members and disposed along the perimeter of the surface thereof to receive the distal ends of the struts, the straightline distance between opposing pocket means being less than the diameter defined by the hub means and a pair of diametrically opposed flexible rods so as to place the said pair of rods in compression, creating an outwardly distended bow in the said rods.

2. The combination of claim 1 wherein the stop means includes:

a plurality of first detent means aligned circumferentially and disposed on the surface of the pivotal sockets; and, second detent means carried by the seats and cooperatively disposed for engagement with the first detent means.

3. The combination of claim 2 wherein the hub means also includes a cap member attachable to the base and adapted to close the rear openings of the cavities.

4. The combination of claim 2 where the seats are carried by the cap member.

5. In a fabric stretching frame having a central hub, the improvement comprising:

a base member having a plurality of cavities, each having opposing side chambers defining bearing means at one end thereof;

a like plurality of pivotal sockets carried by the base member and respectively disposed in the cavities;

journal means integral with each of the sockets and disposed to rotate in the bearing means; and, seat means cooperatively engaging the sockets.

6. The hub of claim 5 wherein the journal means includes a pair of opposed pivot pins coaxial with the axis of rotation of the socket.

7. The hub of claim 5 and further including:

a cap member;

fastener means integral with the cap member; and receiver means in the base member to cooperatively engage the fastener means.

8. The hub of claim 7 and further including:

stop means, comprising:

a plurality of first detent means aligned circumferentially disposed on the surface of the pivotal sockets; and, second detent means carried by the seats and cooperatively disposed for engagement with the first detent means.

* * * * *